US007784781B2

(12) United States Patent
Asada

(10) Patent No.: US 7,784,781 B2
(45) Date of Patent: Aug. 31, 2010

(54) SHEET CASSETTE USED FOR A PRINTER

(75) Inventor: Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 232 days.

(21) Appl. No.: 11/675,827

(22) Filed: Feb. 16, 2007

(65) Prior Publication Data

US 2007/0194516 A1 Aug. 23, 2007

(30) Foreign Application Priority Data

Feb. 21, 2006 (JP) ..... 2006-043839

(51) Int. Cl.
*B65H 1/00* (2006.01)

(52) U.S. Cl. ..... 271/145; 399/393

(58) Field of Classification Search ..... 271/145, 271/147; 399/393; 221/6
See application file for complete search history.

(56) References Cited

U.S. PATENT DOCUMENTS 5,028,041 A * 7/1991 Kobayashi ..... 271/9.03
6,206,362 B1 * 3/2001 Tan et al. ..... 271/145
6,561,506 B2 * 5/2003 Sasaki et al. ..... 271/145

FOREIGN PATENT DOCUMENTS

| | | | |
|---|---|---|---|
| JP | 59153742 A | * | 9/1984 |
| JP | S63-148646 U | | 9/1988 |
| JP | 01226648 A | * | 9/1989 |
| JP | H07-112853 A | | 5/1995 |
| JP | H11-011743 A | | 1/1999 |
| JP | H11-035205 A | | 2/1999 |

OTHER PUBLICATIONS

Japanese Patent Office, Japanese Office Action issued in corresponding Japanese Application No. 2006-043839, mailing date of Oct. 7, 2008.

* cited by examiner

*Primary Examiner*—Patrick Mackey
*Assistant Examiner*—Ernesto Suarez
(74) *Attorney, Agent, or Firm*—Baker Botts L.L.P.

(57) ABSTRACT

A sheet cassette used for a printer has a tray, a cover, and a sheet indicator. The tray accommodates a sheet stack therein, the tray having an open upper portion. The cover covers at least a part of the open upper portion. The sheet indicator is provided in the cover and configured to contact with an uppermost sheet of the sheet stack and indicate a thickness of the sheet stack.

6 Claims, 8 Drawing Sheets

SHEET CASSETTE USED FOR A PRINTER

CROSS REFERENCE TO RELATED APPLICATIONS

This application claims priority from Japanese Patent Application No. 2006-043839 filed Feb. 21, 2006. The entire content of the priority application is incorporated herein by reference.

TECHNICAL FIELD

The present invention relates to a sheet cassette used for a printer. In particular, the present invention relates to a sheet cassette having a sheet indicator visually indicating an amount of sheets accommodated therein.

BACKGROUND

Conventionally, a printing device such as a facsimile machine or a printer has a sheet cassette to accommodate stacked sheets for printing. As shown in FIG. 1A, the sheet cassette 200 includes a sheet tray 220 for accommodating stacked sheets and a cover 230 for covering a part of an open upper portion of the tray 220. The sheet tray 220 is generally provided with a sheet indicator 240 indicating the remaining amount of sheets therein. The sheet indicator 240 has a pointer 242*a* provided in a front side of the sheet tray 220. As shown in FIGS. 1B and 1C, the sheet indicator 240 is formed of a link stem 242 and an L-shaped link stem 244. One end of the link stem 242 forms the pointer 242*a*. One end 244*a* of the L-shaped link stem 244 contacts with an uppermost sheet, and the other end 244*b* of the L-shaped link stem 244 is coupled with the other end 242*b* of the link stem 242.

Japanese Patent Published Application No. Hei 11-35205 discloses a roll detector provided in an upper side of a printer for displaying residual quantity of roll paper. Japanese Patent Published Application No. Hei 11-11743 discloses an end sensor which contacts with an uppermost sheet to detect imminent out of paper.

The above sheet indicator might intervene the refill of sheets into the tray 220, so that the sheets are required to be refilled, while avoiding the sheet indicator 240. In addition, since the sheet indicator 240 is positioned beside the side face of the tray 200, a width of the tray 220 needs to be extended by the length occupied by the sheet indicator 240. Furthermore, since the sheet indicator 240 is disposed alongside the stacked sheets, it is difficult for a user to easily confirm the pointer 242*a* positioned near the side end of the tray 220.

SUMMARY

To solve the above-mentioned problems, an object of the present invention is to provide a sheet cassette provided with a sheet indicator which contributes to manufacturing a compact printer.

The present invention provides a sheet cassette used for a printer. The sheet cassette has a tray, a cover, and a sheet indicator. The tray accommodates a sheet stack therein, the tray having an open upper portion. The cover covers at least a part of the open upper portion. The sheet indicator is provided in the cover and configured to contact with an uppermost sheet of the sheet stack and indicate a thickness of the sheet stack.

The present invention provides a printer having a housing, a sheet cassette, and a roller. The housing includes a printing head to print on a sheet. The sheet cassette is loadable in the housing. The sheet cassette has a tray, a cover, and a sheet indicator. The tray accommodates a sheet stack made from the sheet therein. The tray has an open upper portion. The cover covers at least a part of the open upper portion. The sheet indicator is provided in the cover and has a contact portion contactable with an uppermost sheet of the sheet stack. The sheet indicator indicates a thickness of the sheet stack. The roller feeds the uppermost sheet from the sheet cassette to the printing head in a sheet feed direction. The contact portion is aligned with the sheet feed roller in the sheet feeding direction when the sheet cassette is loaded in the housing.

BRIEF DESCRIPTION OF THE DRAWINGS

The particular features and advantages of the invention as well as other objects will become apparent from the following description taken in connection with the accompanying drawings, in which.

DETAILED DESCRIPTION

The next description will be made for explaining an embodiment according to the present invention, referring to the attached drawings. In the following description, the expressions "front", "rear", "above", "below", "right", and "left" are used throughout the description to define the various parts when a sheet cassette according to the present invention is disposed in an orientation in which it is intended to be used.

Figure 2:
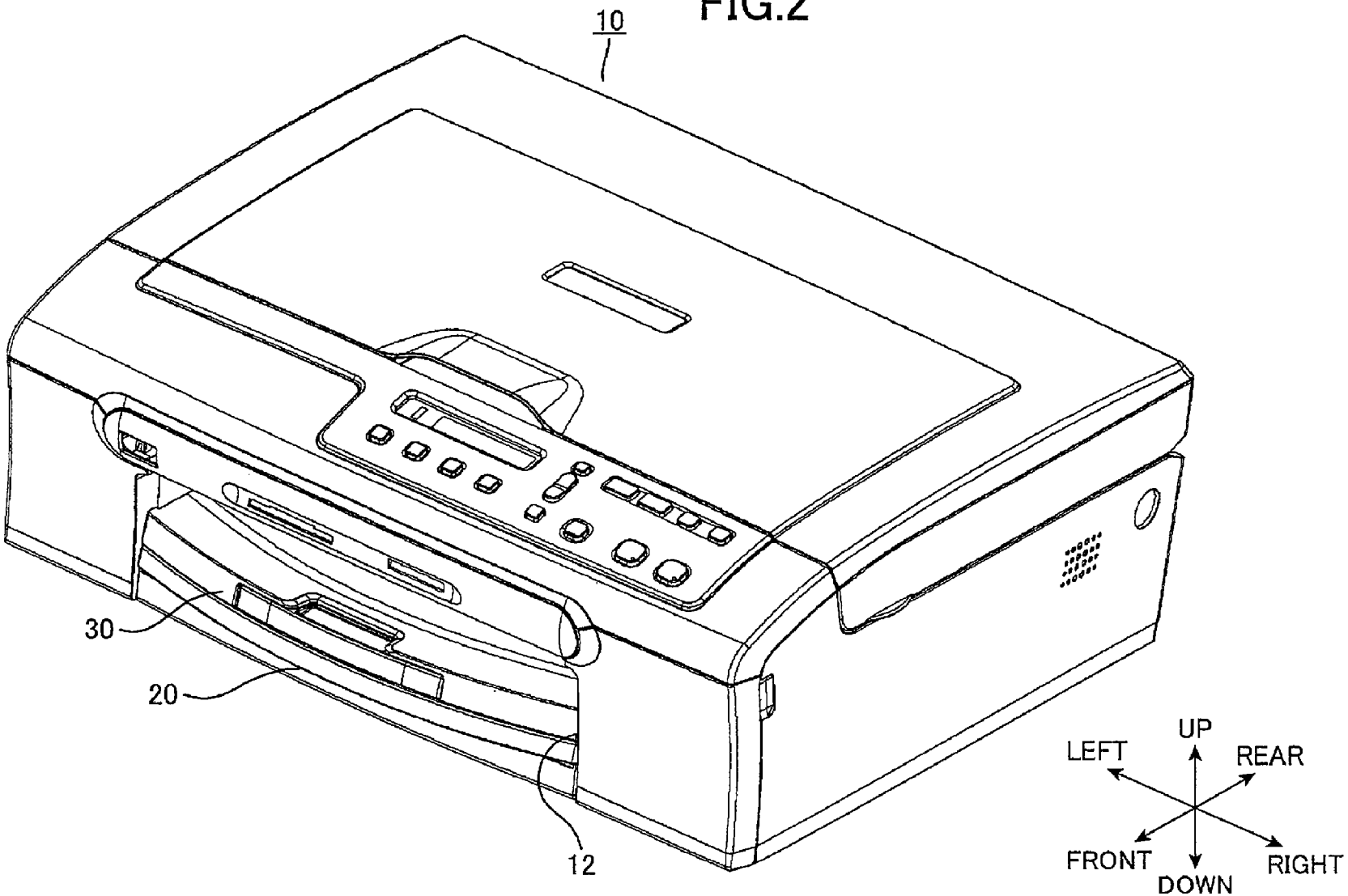
FIG. 2 is a perspective view showing a sheet cassette of the present invention loaded in a printer.

FIG. 2 shows a printer 10 for printing on a sheet, and a sheet cassette 20 loaded in the printer 10 for accommodating the sheet for the printer 10. The printer 10 includes an ink jet head (not shown) for printing on the sheet fed from the sheet cassette 20, and a sheet feed roller 16 (FIG. 3) for feeding the sheet from the sheet cassette 20 to the ink jet head in a sheet conveying direction as indicated by an arrow A shown in FIG.

3. A cassette inlet 12 is provided in the front side of the printer 10 to load the sheet cassette 20 therein.

Figure 4:
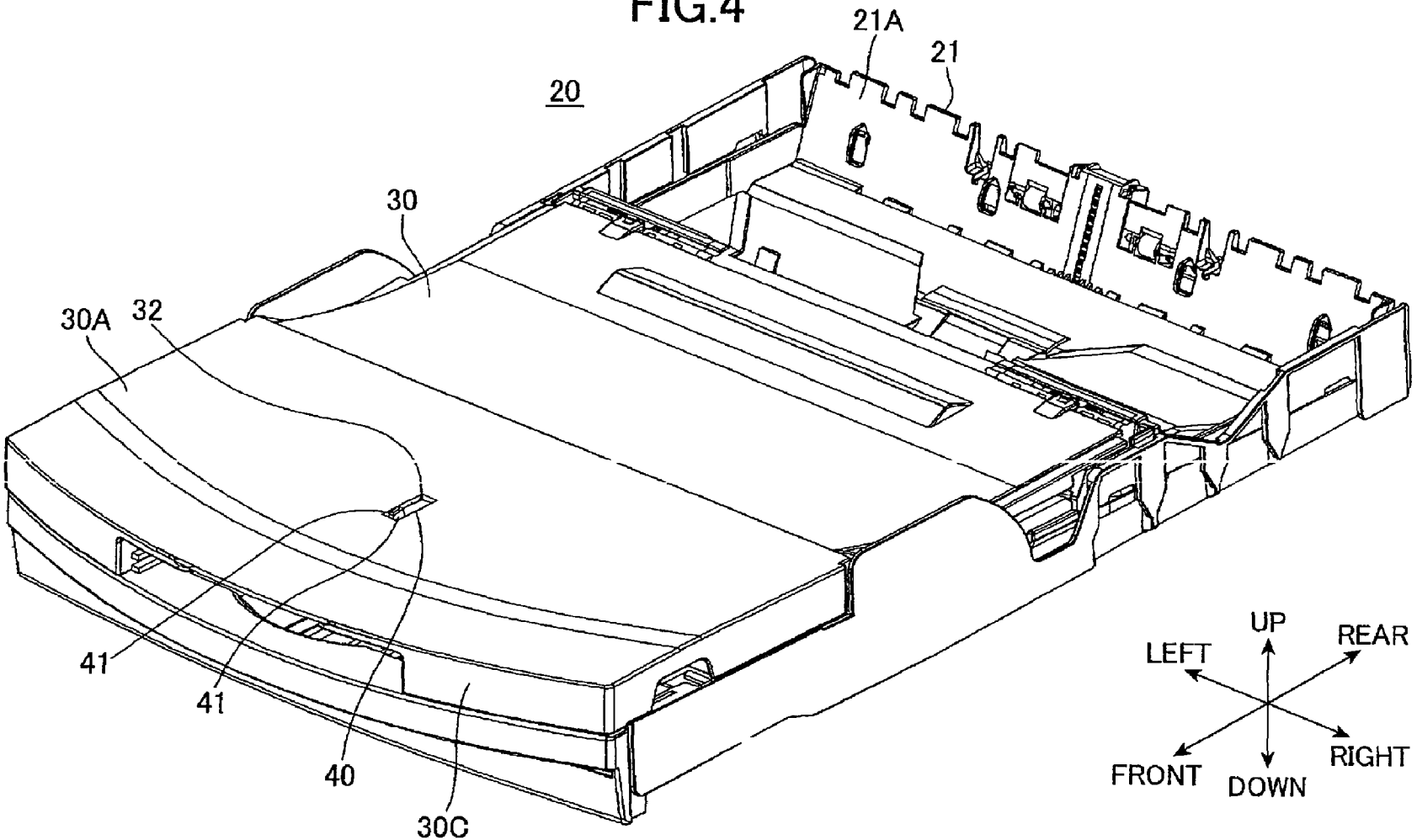
FIG. 4 is a perspective view showing the sheet cassette of FIG. 3.

Referring to FIG. 4, the sheet cassette 20 has a sheet tray 21 for stacking and accommodating a plurality of A4 size sheets as a sheet stack therein. The sheet tray 21 has a substantially box shape having an open upper portion. The sheet cassette 20 further has a cover 30 for covering at least a part of the open upper portion 21A of the sheet tray 21. The cover 30 has an upper surface 30A, an inner surface 30B facing the sheet tray 21, and a front surface 30C. The upper surface 30A is shaped a sheet discharge tray for receiving the sheet on which printing has been performed.

Figure 5A:
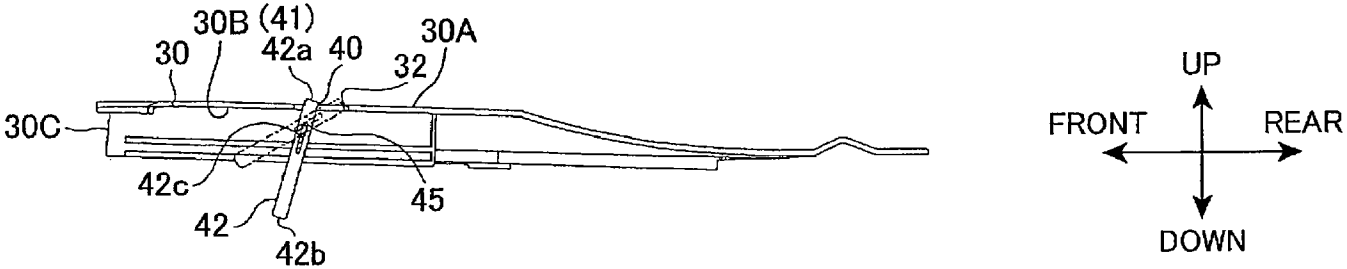
FIG. 5A is a vertical sectional view showing a cover with a sheet indicator.

As shown in FIG. 4, the cover 30 includes a sheet indicator 40 with a pointer 41 which is formed in the upper surface 30A for indicating a thickness of the sheet stack, i.e., the remaining amount of sheets in the tray 21. As shown in FIG. 5A, the sheet indicator 40 is provided in the cover 30. The sheet indicator 40 includes a rod member 42 made of a resin and a shaft 45 for movably supporting the rod member 42 to the cover 30. The rod member 42 has a long hole 42*c* extending in the longitudinal direction at a middle position. The shaft 45 is supported to a pair of protrusions (not shown) which extend downward from the inner surface 30B of the cover 30. The shaft 45 is passed through the long hole 42*c* to support the rod member 42 movably in the vertical direction and pivotably around the shaft 45. An opening 32 is formed in the upper surface 30A between the pair of protrusions. An upper end 42*a* of the rod member 42 passes through the opening 32. The rod member 42 has a sufficient length so that a lower end 42*b* thereof is contactable with an uppermost sheet of the sheet stack regardless of the remaining amount of sheets in the tray 21. Accordingly, the upper end 42*a* of the rod member 42 is visible through the opening 32 to form the pointer 41.

Figure 5B:
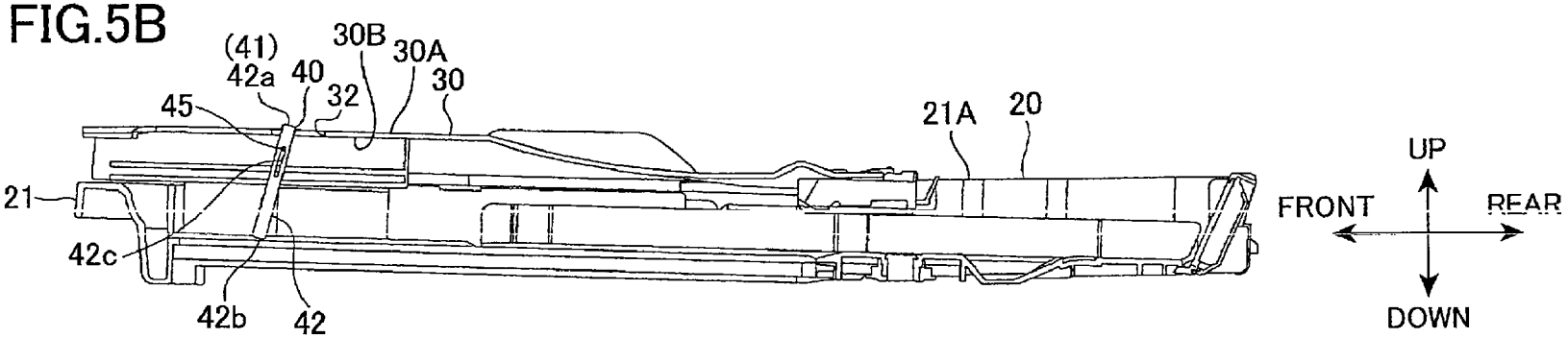
FIG. 5B is a vertical sectional view showing a sheet cassette with a tray accommodating no sheet.

The next description will be made for explaining the operation of the sheet indicator 40 according to the remaining amount of sheets in the sheet cassette 20. When the tray 21 accommodates no sheet therein, as shown in FIG. 5B, the tray 21 has sufficient internal space between the open upper portion 21A and the bottom, so that the rod member 42 rises up due to its own weight. At this time, the upper end 42*a* of the rod member 42 is positioned beside the mark labeled "empty" (not shown) on the upper surface 30A.

Figure 5C:
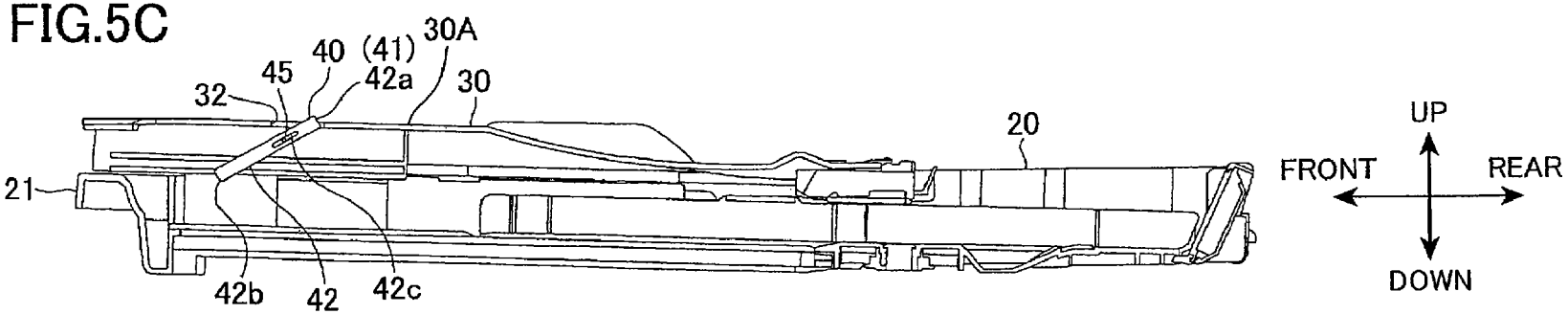
FIG. 5C is a vertical sectional view showing the sheet cassette with the tray accommodating the maximum amount of sheets.

On the other hands, when the tray 21 accommodates the maximum amount of sheets (not shown), as shown in FIG. 5C, the rod member 42 is inclined from the vertical direction to a large extent. At this time, the upper end 42*a* of the rod member 42 is positioned beside the mark labeled "full" (not shown) on the upper surface 30A. Thus, the rod member 42 gradually rises up to indicate the current amount of sheets in the tray 21, as the sheets in the tray 21 decreases due to the printing.

As described above, the upper end 42*a* is moved in the opening 32 depending on the remaining amount of sheets in the tray 21. For example, when the sheets are accommodated in the tray 21 to the maximum as shown in FIG. 5C, the upper end 42*a* of the rod member 42 is located at the right end of the opening 32. Then, the upper end 42*a* gradually moves to left, as the thickness of the sheet stack is reduced. Finally, when all sheets are removed from the tray 21, as shown in FIG. 5B, the upper end 42*a* is located at the left end of the opening 32. Accordingly, the remaining amount of sheets in the sheet cassette 20 is easily and visually confirmed without detaching the cover 30 from the tray 21.

In this embodiment, the shaft 45 is inserted through the long hole 42*c* of the rod member 42 to support the rod member 42 movably in the vertical direction. Further, the projecting amount of the rod member 42 from the opening 32 is minimized. If the rod member 42 is supported by the shaft 45 without any play, the projecting length of the rod member 42 from the opening 32 is increased, as the rod member 42 gradually rises up. However, because the shaft 45 is movable in the long hole 42*c* and the level of the uppermost sheet in the tray 21 is gradually lowered, the rod member 42 gradually lowers with respect to the shaft 45 due to its own weight, as shown in FIG. 5B. Therefore, the protruding length of the rod member 42 from the opening 32 can be minimized. Accordingly, the rod member 42 can be prevented from interfering with other components in the printer 10. Therefore, the printer 10 can be made compact.

Figure 1A:
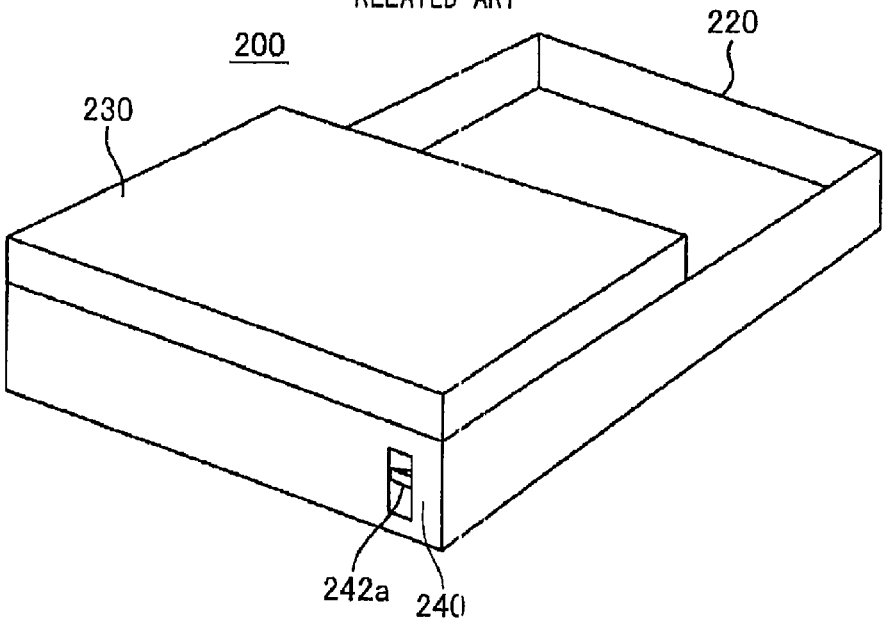
FIG.1A RELATED ART
FIG. 1A is a perspective view showing a conventional sheet cassette provided with a sheet indicator.
Figure 1B:
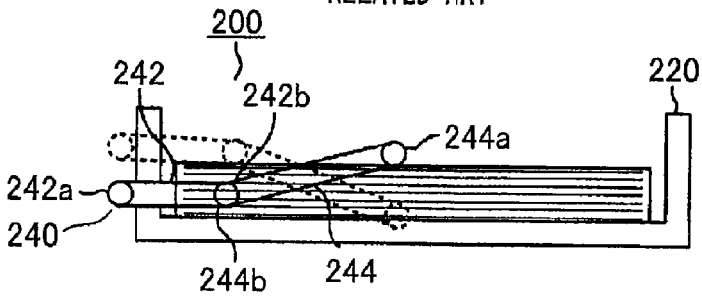
FIG.1B RELATED ART
FIG. 1B is a side sectional view showing the conventional sheet indicator.
Figure 1C:
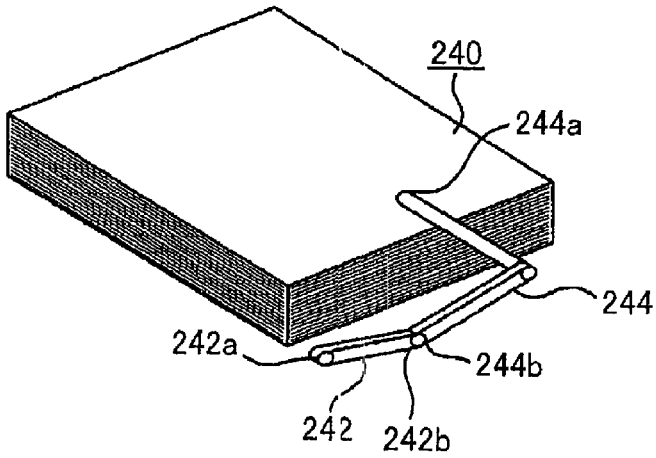
FIG.1C RELATED ART
FIG. 1C is a perspective view showing the sheet indicator of FIG. 1B.

In this embodiment, the sheet indicator 40 is provided in the cover 30 rather than the tray 21. Therefore, when the cover 30 is removed from the tray 21 in order to refill sheets into the sheet cassette 20, the sheets can be easily refilled into the tray 21 without paying attention to space for the sheet indicator 40. This is because the sheet indicator 40 does not obstruct the refill of sheets. Further, the sheet indicator 40 is located above the tray 21. Compared to the conventional sheet indicator provided beside the side face of the tray 21 as shown in FIG. 1, a width of the sheet cassette 20 can be made smaller. Furthermore, since the sheet indicator 40 need not be provided beside a side face of the tray 21, this structure provides more flexibility to arrange a sheet indicator 40 in the sheet cassette 20. Preferably, the sheet indicator 40 is provided at the widthwise center of the cover 30. Accordingly, the indicator 42*a* is easy to be visually confirmed.

In this embodiment, the cover 30 functions as a sheet discharge tray, it is unnecessary to provide a sheet discharge tray separately from the cover 30. Therefore, the printer can be minimized. Further, since the pointer 41 of the sheet indicator 40 is formed in the cover 30, it is easy to visually confirm the remaining amount of sheets in the sheet cassette 20 from above. For example, regarding a printer for selectively loading a plurality of sheet cassettes therein, the remaining amount of sheets in each sheet cassette can be visually confirmed with ease.

Figure 3:
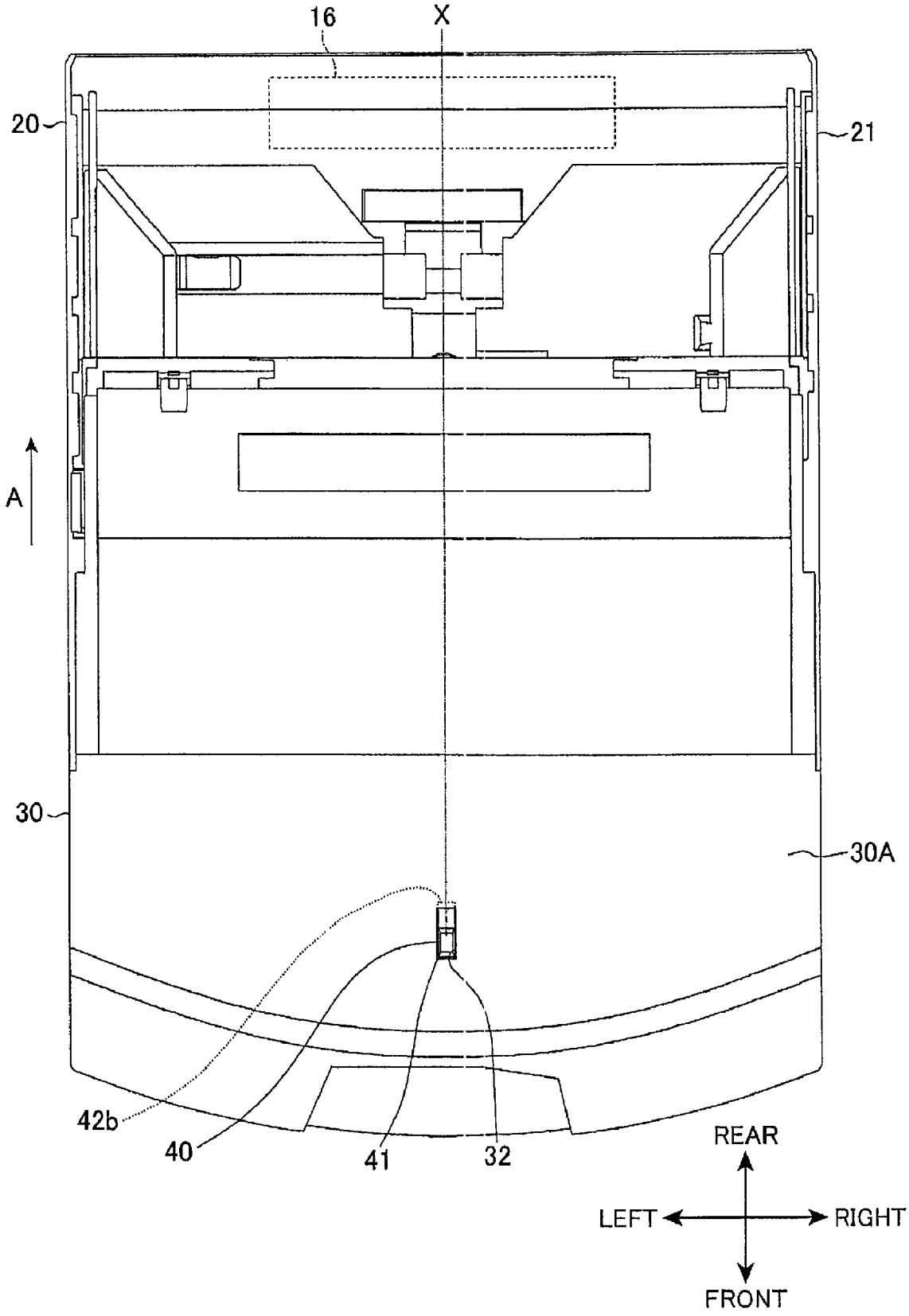
FIG. 3 is a plan view showing the sheet cassette of FIG. 2.

When the sheet cassette 20 is loaded in the printer 10, as shown in FIG. 3, the lower end 42*b* of the rod member 42 is aligned, along a line X, with the sheet feed roller 16 in the sheet conveying direction A.

Figure 6:
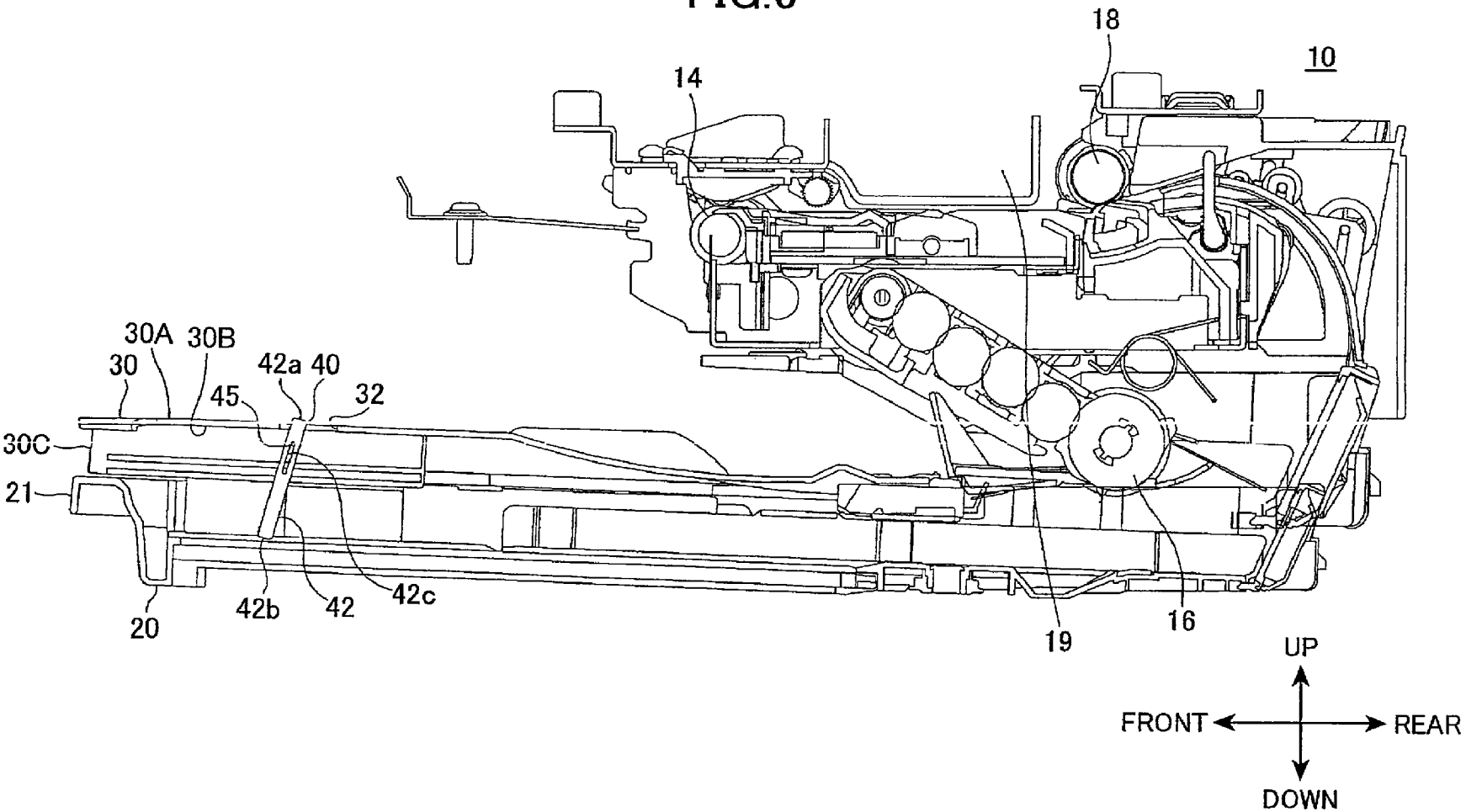
FIG. 6 is a vertical sectional view showing a sheet cassette loaded in the printer.

Sheet feeding from the sheet cassette 20 to the ink jet head will be described with reference to FIG. 6. The printer 10 includes a conveyance roller 18, an ink jet head 19, and a conveyance roller 14 arranged in this order along the a sheet conveying path. As described above, the sheet accommodated in the sheet cassette 20 is sent to the conveyance roller 18 by the sheet feed roller 16, printed by the ink jet head 19, and discharged to the cover 30 by the conveyance roller 14. As described above with reference to FIG. 3, the lower end 42*b* of the rod member 42 is aligned with the sheet feed roller 16 in the sheet conveyance direction A. When the sheet is conveyed by the sheet feed roller 16, any force generated by a contact resistance between the lower end 42*b* of the rod member 42 and the sheet is not exerted on the sheet in any direction rather than the sheet conveying direction A. Accordingly, feed of the sheet in any direction except the sheet conveying direction A is prevented.

A sheet cassette 20 of the second embodiment according to the present invention will be described with reference to FIGS. 7 and 8.

Figure 7:
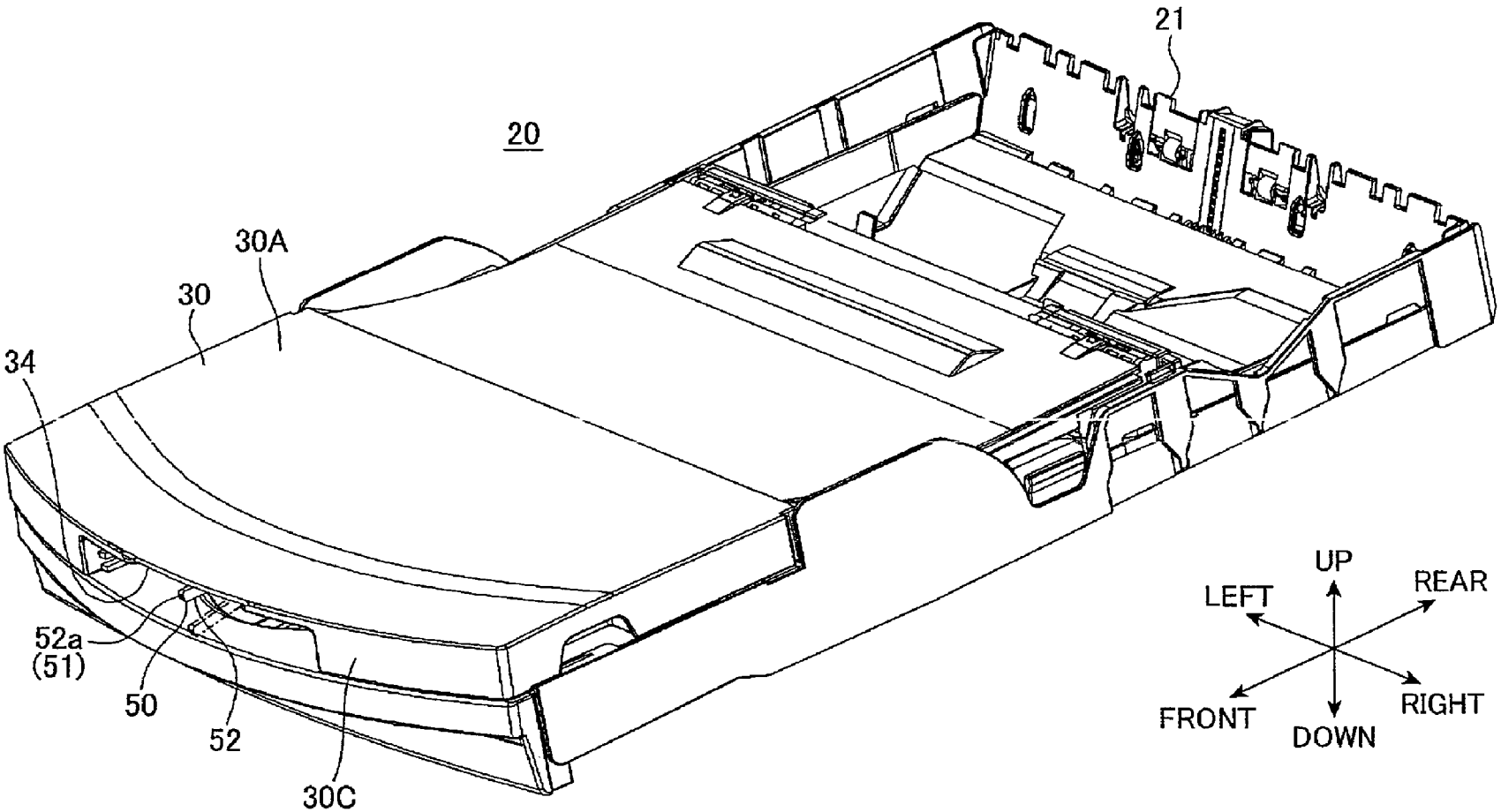
FIG. 7 is a perspective view showing a sheet cassette of another embodiment of the present invention.

Referring to FIG. 7, the sheet cassette 20 has a sheet indicator 50 provided in the cover 30. The sheet indicator 50 has a pointer 51 formed in the front surface 30C for indicating a thickness of the sheet stack in the tray 21. As shown in FIG.

8A, the sheet indicator 50 includes a main member 52 and an auxiliary member 54, both of which are made of a resin.

The main member 52 has a bent vertical cross section to have a first bar portion 52A and a second bar portion 52B connected integrally with the first bar portion 52A. The first bar portion 52A is formed longer than the second bar portion 52B. The main member 52 is pivotably supported about a first shaft 55 provided in the cover 30. The first shaft 55 is attached and fixed to a first pair of protrusions (not shown) extending downward from the inner surface 30B of the cover 30. The bar portion 52A has a lower end 52*a* which is contactable with the uppermost sheet of the sheet stack in the tray 21. The bar portion 52A has a sufficient length so that the lower end 52*a* is contactable with an uppermost sheet of the sheet stack regardless of the remaining number of sheets in the tray 21.

The auxiliary member 54 has a bent vertical cross section to have a first bar portion 54A and a second bar portion 54B connected integrally with the first bar portion 54A. The first bar portion 54A is formed shorter than the second bar portion 54B. The auxiliary member 54 is pivotably supported about a second shaft 57 provided in the cover 30. The second shaft 57 is attached and fixed to a second pair of protrusions (not shown) extending downward from the inner surface 30B of the cover 30 and between the first pair of protrusions and the front surface 30C. The first bar portion 54A has one end 54*a* which is slidably contactable with one end 52*b* of the second bar portion 52B from below. An opening 34 is formed in the front surface 30C of the cover 30. One end 54*b* of the second bar member 54B is inserted in the opening 34. Accordingly, the one end 54*b* is visible through the opening 34 from outside to form the pointer 51.

Figures 8A, 8B, 8C:
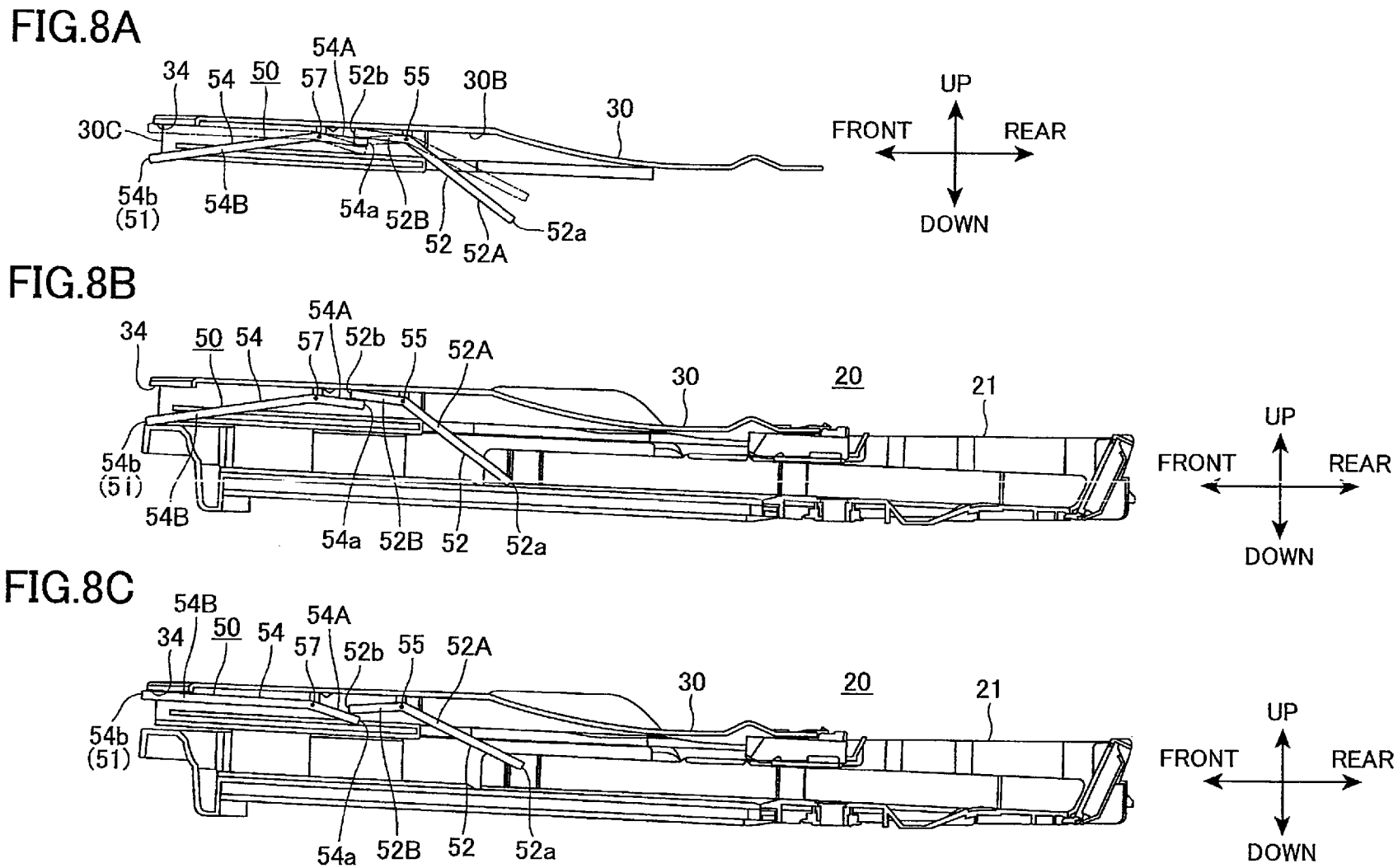
FIG. 8A is a vertical sectional view showing a cover shown in FIG. 7, provided with a sheet indicator.
FIG. 8B is a vertical sectional view showing the sheet cassette shown in FIG. 7 in which the tray accommodates no sheet.
FIG. 8C is a vertical sectional view showing the sheet cassette shown in FIG. 7 in which the tray accommodates the maximum amount of sheets.

The next description will be made for explaining the operation of the sheet indicator 50 according to the remaining amount of sheets in the sheet cassette 20. When the tray 21 accommodates no sheet, as shown in FIG. 8B, the main member 52 rotates about the first shaft 55 in the clockwise direction, and the lower end 52*a* lowers and the other end 52*b* rises. Accordingly, the auxiliary member 54 rotates about the second shaft 57 in the counterclockwise direction, and the one end 54*b* lowers to be positioned at a lowest position as the pointer 51.

On the other hands, when the tray 21 accommodates the maximum amount of sheets (not shown), as shown in FIG. 8C, the main member 52 rotates about the first shaft 55 in the counterclockwise direction, and the one end 52*a* rises and the other end 52*b* lowers to press down the end 54*a* of the auxiliary member 54. Therefore, the auxiliary member 54 rotates about the second shaft 57 in the clockwise direction and the one end 54*b* rises to be positioned at a highest position as the pointer 51. Thus, as the amount of sheets in the tray 21 is decreased from the state of FIG. 8C to the state of FIG. 8B, the auxiliary member 54 rotates to change the position of the one end 54*b* in the vertical direction. In other words, when the sheets are accommodated to the maximum as shown in FIG. 8C, the indicator 51 is located in the vicinity of the upper end of the opening 34. Then, as the remaining amount of sheets is reduced, the pointer 51 is located in the vicinity of the lower end of the opening 34. Thus, the remaining amount of sheets in the tray 21 can be visually and easily confirmed without unloading the sheet cassette 20 from the printer 10.

In this embodiment, the sheet indicator 50 is provided at the cover 30 rather than the tray 21. Therefore, when the cover 30 is removed from the tray 21 in order to refill sheets into the sheet cassette 20, the sheets can be easily refilled into the tray 21 without paying attention to the sheet indicator 50. This is because the sheet indicator 50 does not obstruct the refill of sheets. Further, since the sheet indicator 50 is located above the tray 21. Compared to the conventional sheet indicator provided in the side face of the tray 21, a width of the sheet cassette 20 can be made smaller. Furthermore, since the sheet indicator 50 need not be provided beside a side face of the tray 21, this structure provides more flexibility to arrange a sheet indicator 50 in the sheet cassette 20. When the pointer 51 is located at the center of the front surface 30C, the pointer 51 is easy to be visually confirmed.

In this embodiment, the pointer 51 is provided in the front surface 30C of the cover 30. Therefore, even if the sheet cassette 20 is loaded in the printer 10, the remaining amount of sheets in the tray 21 can be easily confirmed. Because the sheet indicator 50 is formed of two members; the main member 52 and the auxiliary member 54, the sheet indicator 50 can be manufactured with simple configuration at lower costs. In this embodiment, the main member 52 is separated from the auxiliary 54. In another embodiment, the main member 52 may be movably joined to the auxiliary member 54 through a hinge.

In this embodiment, when the sheet cassette 20 is loaded into the printer 10 as described about the previous embodiment, the lower end 42*b* of the main member 52 is aligned with the sheet feed roller 16 of the printer 10 in the sheet conveying direction A, as shown in FIG. 3. Therefore, when the sheet is conveyed by the sheet feed roller 16, any force generated by a contact resistance between the lower end 52*a* of the main member 52 and the sheet is not exerted on the sheet in any direction rather than the sheet conveying direction A. Accordingly, feed of the sheet in any direction except the sheet conveying direction A is prevented.

It is understood that the foregoing description and accompanying drawings set forth the embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. A sheet cassette used for a printer, comprising:

a tray that accommodates a sheet stack therein, the tray having an open upper portion;

a cover that covers at least a part of the open upper portion, the cover having an opening formed therethrough, an upper surface formed with the opening, and an inner surface facing the tray, wherein the opening extends between the upper surface and the inner surface; and a sheet indicator comprising:

a rod member having a long hole formed therethrough, and extending in a longitudinal direction of the rod member, the rod member having a lower end to form a contact portion configured to contact with an uppermost sheet of the sheet stack, and an upper end to form a pointer exposed through the opening, wherein the sheet indicator is configured to pivot, in accordance with a thickness of the sheet stack, while the contact portion is in contact with the uppermost sheet, and wherein the sheet indicator is configured to pivot as the pointer moves along the opening to indicate the thickness of the sheet stack; and a shaft provided on and fixed to the inner surface, the shaft passing through the long hole to support the rod member movably in the longitudinal direction and pivotally around the shaft.

2. The sheet cassette according to claim 1, wherein the upper surface of the cover functions as a sheet discharge tray to receive a printed sheet therein.

3. A printer comprising:

a housing;

a printing head to print on a sheet, the printing head disposed inside the housing;

a sheet cassette loadable in the housing, the sheet cassette comprising a tray that accommodates a sheet stack made from the sheet therein, the tray having an open upper portion;

a cover that covers at least a part of the open upper portion, the cover having an opening formed therethrough, an upper surface formed with the opening, and an inner surface facing the tray, wherein the cover opening extends between the upper surface and the inner surface; and a sheet indicator comprising:

a rod member having a long hole formed therethrough, and extending in a longitudinal direction of the rod member, the rod member having a lower end to form a contact portion configured to contact with an uppermost sheet of the sheet stack, and an upper end to form a pointer exposed through the opening, wherein the sheet indicator is configured to pivot, in accordance with a thickness of the sheet stack, while the contact portion is in contact with the uppermost sheet, and wherein the sheet indicator is configured to pivot as the pointer moves along the opening to indicate the thickness of the sheet stack;

a shaft provided on and fixed to the inner surface, the shaft passing through the long hole to support the rod member movably in the longitudinal direction and pivotally around the shaft; and a roller for feeding the uppermost sheet from the sheet cassette to the printing head in a sheet feed direction, wherein the contact portion is aligned with the sheet feed roller in the sheet feeding direction when the sheet cassette is loaded in the housing.

4. The printer according to claim 3, wherein the pointer is visible from outside of the housing, when the sheet cassette is loaded in the housing.

5. The printer according to claim 4, wherein the housing further comprises a cassette inlet for loading the sheet cassette therethrough to the housing.

6. The sheet cassette according to claim 1, wherein the opening has a first end and a second end opposite the first end, wherein the pointer is configured to move between the first end and the second end of the opening corresponding to the pivotal movement of the sheet indicator.

* * * * *